US010266932B2

(12) United States Patent
Mohanty et al.

(10) Patent No.: US 10,266,932 B2
(45) Date of Patent: Apr. 23, 2019

(54) OPTIMIZATION OF ALUMINUM HOT WORKING

(71) Applicant: Novelis Inc., Atlanta, GA (US)

(72) Inventors: Rashmi Ranjan Mohanty, Roswell, GA (US); Duane E. Bendzinski, Woodstock, GA (US); Rahul Vilas Kulkarni, Marietta, GA (US)

(73) Assignee: NOVELIS INC., Atlanta, GA (US)

( * ) Notice: Subject to any disclaimer, the term of this patent is extended or adjusted under 35 U.S.C. 154(b) by 253 days.

(21) Appl. No.: 15/276,955

(22) Filed: Sep. 27, 2016

(65) Prior Publication Data

US 2017/0101705 A1 Apr. 13, 2017

Related U.S. Application Data

(60) Provisional application No. 62/238,960, filed on Oct. 8, 2015.

(51) Int. Cl.

| | |
|---|---|
| ***C22F 1/053*** | (2006.01) |
| ***C22C 21/10*** | (2006.01) |
| ***B21B 3/00*** | (2006.01) |
| ***B21B 45/00*** | (2006.01) |
| ***B21D 22/02*** | (2006.01) |

(52) U.S. Cl.

CPC ..... *C22F 1/053* (2013.01); *B21B 3/00* (2013.01); *B21B 45/004* (2013.01); *B21D 22/022* (2013.01); *C22C 21/10* (2013.01); *B21B 2003/001* (2013.01)

(58) Field of Classification Search

None

See application file for complete search history.

(56) References Cited

U.S. PATENT DOCUMENTS 3,874,213 A * 4/1975 Sperry ..... B21C 23/002 148/550
4,098,624 A * 7/1978 Laird, Jr. ..... C21D 1/00 148/631
4,486,242 A 12/1984 Ward et al.
4,830,682 A * 5/1989 Ashton ..... C22F 1/04 148/564
6,322,647 B1 * 11/2001 Kamat ..... C22F 1/053 148/437

(Continued)

OTHER PUBLICATIONS

Taleff et al., "Tensile Ductility of Several Commercial Aluminum Alloys At Elevated Temperatures", Metallurgical and Materials Transactions A, May 2001, pp. 1119-1130, vol. 32A, Springer, US.

(Continued)

*Primary Examiner* — George Wyszomierski

(74) *Attorney, Agent, or Firm* — Kilpatrick Townsend & Stockton LLP

(57) ABSTRACT

A method of hot forming an aluminum alloy component may include heating the aluminum alloy component in a heating furnace to a solutionizing temperature, cooling the aluminum alloy component to a desired forming temperature, deforming the aluminum alloy component into a desired shape in a forming device while the aluminum alloy component is at the desired forming temperature, maintaining a constant temperature during the deformation of the aluminum alloy component, and quenching the aluminum alloy component to a low temperature below a solvus temperature.

22 Claims, 7 Drawing Sheets

(56) References Cited

U.S. PATENT DOCUMENTS

| | | | | |
|---|---|---|---|---|
| 2009/0056403 | A1* | 3/2009 | Chanko | B21D 22/022 72/324 |
| 2012/0055588 | A1* | 3/2012 | Kamat | C22C 21/10 148/551 |
| 2012/0085470 | A1 | 4/2012 | Segal | |
| 2012/0152416 | A1 | 6/2012 | Foster et al. | |
| 2012/0273098 | A1 | 11/2012 | Bohner et al. | |

OTHER PUBLICATIONS

Doroshenko et al., "Effect of Admixtures of Iron and Silicon on the Structure and Cracking of Near-Edge Volumes in Rolling of Large Flat Ingots from Alloy 7075," Metal Science and Heat Treatment, 2005, pp. 30-35, vol. 47, Nos. 1-2, Springer, US.

Harnish et al., "High-Temperature Mechanical Behavior and Hot Rolling of AA705X," Metallurgical and Materials Transactions A, Feb. 2005, pp. 357-369, vol. 36A, Springer, US.

"International Alloy Designations and Chemical Composition Limits for Wrought Aluminum and Wrought Aluminum Alloys," Registration Record Series: Teal Sheets, Feb. 1, 2009, The Aluminum Association, Inc., 35 pages.

Rajamuthamilselvan et al., "Hot deformation behaviour of 7075 alloy," Journal of Alloys and Compounds, 2011, pp. 948-952, vol. 509, Elsevier B.V.

Zhuang et al., "Predition of FLD for AA7075 under hot stamping based on continuum damage mechanics," Journal of Jilin University (Engineering and Technology Edition), Mar. 2014, pp. 409-414, vol. 44, No. 2, Jilin University, Changchun, China.

International Patent Application No. PCT/US2016/053898, International Search Report and Written Opinion dated Mar. 21, 2017, 14 pages.

International Application No. PCT/US2016/053898, "International Preliminary Report on Patentability", dated Apr. 19, 2018, 8 pages.

* cited by examiner

OPTIMIZATION OF ALUMINUM HOT WORKING

CROSS REFERENCE TO RELATED APPLICATION

This application is related to and claims priority benefits from U.S. Provisional Application Ser. No. 62/238,960 ("the '960 application"), filed on Oct. 8, 2015, entitled OPTIMIZATION OF ALUMINUM HOT WORKING. The '960 application is hereby incorporated in its entirety by this reference.

FIELD

This invention relates to processes for hot working or hot forming aluminum and optimizing manufacturing variables.

BACKGROUND

Aluminum alloys can be grouped into two categories: heat-treatable alloys and non-heat-treatable alloys. Heat-treatable alloys are capable of being strengthened and/or hardened during an appropriate thermal treatment whereas no significant strengthening can be achieved by heating and cooling non-heat-treatable alloys. Alloys in the 2xxx, 6xxx, and 7xxx series (and some 8xxx alloys) are heat-treatable. Alloys in the 1xxx, 3xxx, 4xxx, and 5xxx series (and some 8xxx alloys) are non-heat-treatable. Hot working is plastic deformation of metal at such temperature and rate that strain hardening (i.e., cold working) does not occur.

A heat-treatable aluminum alloy component ("component") may undergo solution heat treating. Solution heat treating may include three stages: (1) solution heating, which may include both heating and soaking (at a given temperature) of the component; (2) quenching; and (3) aging. The heating and soaking step dissolves large particles and disperses the particles as smaller precipitates or dissolved atoms (acting as soluble hardening elements) to strengthen the component. Quenching, or rapid cooling, effectively freezes or locks the dissolved elements in place (i.e., still dispersed) to produce a solid solution with more alloying elements in solution at room temperature than would otherwise occur with a slow cool down.

The aging step allows the alloying elements dissolved in the solid solution to migrate through cool metal (even at room temperature) but not as fast or as far as they could at high temperatures. Accordingly, atoms of dissolved alloying elements may slowly gather to form small precipitates with relatively short distances between them, but not large, widely-spaced particles. The quantity and high density of small dislocation-pinning precipitates gives the alloy its strength and hardness because the precipitates have a different elastic modulus compared to that of the primary element (aluminum) and thus inhibit movement of the dislocations, which are often the most significant carriers of plasticity. The aging may be natural or artificial. Some alloys reach virtually maximum strength by "natural aging" in a short time (i.e., a few days or weeks). However, at room temperature, some alloys will strengthen appreciably for years. To accelerate precipitation, these alloys undergo "artificial aging," which includes maintaining the component for a limited time at a moderately raised temperature, which increases the mobility of dissolved elements and allows them to precipitate more rapidly than at room temperature.

Conventionally, because some alloys have poor formability (i.e., the ability to undergo plastic deformation without being damaged) at room temperature, to shape components of these alloys into desired geometric shapes, these components may undergo hot working (or hot forming) after solution heating and before quenching at temperatures at or near the solutionizing temperature. For example, see U.S. Patent Application Publication 2012/0152416 (the '416 Publication), which describes that the transfer between the heating station to the forming press should be as fast as possible to avoid heat loss from the aluminum (see paragraph and FIG. 1). Hot working or hot forming processes may include, for example, drawing, extrusion, forging, hot metal gas forming, and/or rolling.

There is a known problem with hot working some aluminum alloys (in particular, 7xxx alloys) where components exhibit unsatisfactory deformability. For example, see N. M. Doroshenko et al., *Effect Of Admixtures Of Iron And Silicon on the Structure and Cracking of Near-Edge Volumes in Rolling of Large Flat Ingots from Alloy* 7075, Metal Science and Heat Treatment, Vol. 47, Nos. 1-2, 2005 at 30 ("Doroshenko"). Doroshenko focuses on hot rolling of 7xxx and the resultant cracks. To address this problem, Doroshenko describes analysis and proposed guidelines for the particular chemical composition of 7xxx alloys.

There is a need for improving the deformability of aluminum alloys (particularly 7xxx alloys) during hot forming processes without exhaustive analysis and modification of the chemical composition of the alloy.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain examples of the present invention, a method of hot forming an aluminum alloy component comprises: heating the aluminum alloy component in a heating furnace to a solutionizing temperature; cooling the aluminum alloy component to a desired forming temperature in a range of approximately 380° C. to approximately 470° C.; deforming the aluminum alloy component into a desired shape in a forming device while the aluminum alloy component is at the desired forming temperature; and quenching the aluminum alloy component to a low temperature below a solvus temperature wherein the low temperature is in a range of approximately 0° C. to approximately 280° C.

In some examples, the aluminum alloy component comprises a 7xxx alloy. In certain examples, the aluminum alloy component comprises a 7075 alloy.

In some cases, the desired forming temperature range may be approximately 390° C. to approximately 460° C. or in a range of approximately 400° C. to approximately 440° C. In some cases, the desired forming temperature is approximately 425° C.

The solutionizing temperature, in certain examples, is in a range of approximately 400° C. to approximately 600° C. In some examples, the solutionizing temperature is in a range of approximately 420° C. to approximately 590° C. or approximately 460° C. to approximately 520° C. In some examples, the solutionizing temperature has a minimum value of 480° C. and in some cases is equal to approximately 480° C.

In certain examples, the method of hot forming an aluminum alloy component includes artificially aging the aluminum alloy component.

The method of hot forming an aluminum alloy component, in some examples, includes maintaining a constant temperature during the deformation of the aluminum alloy component wherein the constant temperature is held ±10° C.

In some examples, the aluminum alloy component comprises an ingot, the forming device comprises a rolling mill, and the desired shape comprises a plate or a sheet. In some cases, the forming device is a forming press.

The method of hot forming an aluminum alloy component, in some examples, includes maintaining the aluminum alloy component at the solutionizing temperature for a predetermined time.

In certain examples, the method of hot forming an aluminum alloy component includes transferring the aluminum alloy component from the heating furnace to the forming device through an insulated enclosure.

In some examples, the quenching comprises die quenching with water flowing internally through a die such that the aluminum alloy component is cooled at a minimum rate of approximately 50° C./second. The cooling rate may be between approximately 50° C./second and approximately 500° C./second, and, in some examples, may be between 300° C./second and approximately 350° C./second.

According to certain examples, a method of hot forming an aluminum alloy component comprises: heating the aluminum alloy component in a heating furnace to a solutionizing temperature of approximately 480° C.; cooling the aluminum alloy component to a desired forming temperature in a range of approximately 400° C. to approximately 440° C.; deforming the aluminum alloy component into a desired shape in a forming device while the aluminum alloy component is at the desired forming temperature; maintaining a constant temperature during the deformation of the aluminum alloy component, wherein the constant temperature is held ±10° C.; and quenching the aluminum alloy component to a low temperature below a solvus temperature, wherein the low temperature is approximately 23° C.

In some examples, the aluminum alloy component comprises a 7xxx alloy. In certain embodiments, the aluminum alloy component comprises a 7075 alloy.

In certain examples, the method of hot forming an aluminum alloy component includes artificially aging the aluminum alloy component.

In some examples, the aluminum alloy component comprises an ingot, the forming device comprises a rolling mill, and the desired shape comprises a plate or a sheet.

The forming device, in certain examples, comprises a forming press.

The method of hot forming an aluminum alloy component, in some examples, includes maintaining the aluminum alloy component at the solutionizing temperature for a predetermined time.

In certain examples, the method of hot forming an aluminum alloy component includes transferring the aluminum alloy component from the heating furnace to the forming device through an insulated enclosure.

In some examples, the quenching comprises die quenching with water flowing internally through a die such that the aluminum alloy component is cooled at a rate between approximately 50° C./second and approximately 500° C./second.

The methods described herein may prevent edge cracking on ingots during hot rolling processes for aluminum alloys, including 7xxx alloys, such as but not limited to 7075 alloy. In addition, the disclosed processes may be used to optimize joining processes and other forming processes such as hot gas forming, drawing, extrusion, and forging. These optimizations can increase production efficiency, improve yields, reduce energy expenditures, reduce scrap, and improve overall productivity. These improvements to hot forming of 7xxx alloys may have significant implications for numerous industries where high strength-to-weight ratio materials are desired such as, for example, the transportation and aerospace industries, particularly the manufacture of motor vehicles such as automobiles and trucks.

BRIEF DESCRIPTION OF THE DRAWINGS

Illustrative, but non-limiting, embodiments of the present invention are described in detail below with reference to the following drawing figures.

DETAILED DESCRIPTION

This section describes non-limiting examples of processes for hot forming aluminum alloys and does not limit the scope of the claimed subject matter. The claimed subject matter may be embodied in other ways, may include different elements or other attributes, and may be used in conjunction with other existing or future technologies. This description should not be interpreted as requiring any particular order or arrangement among or between various elements.

In this description, reference is made to alloys identified by AA numbers and other related designations, such as "series." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

Figure 1:
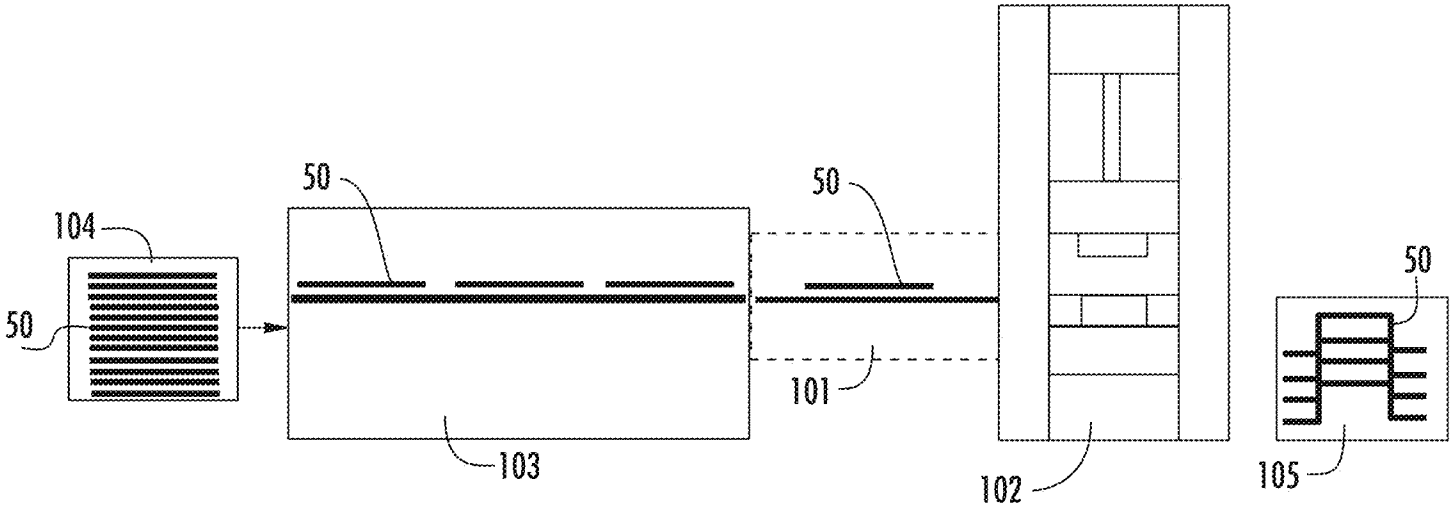
FIG. 1 is a schematic view of an exemplary method of hot forming an aluminum alloy component.
Figure 2:
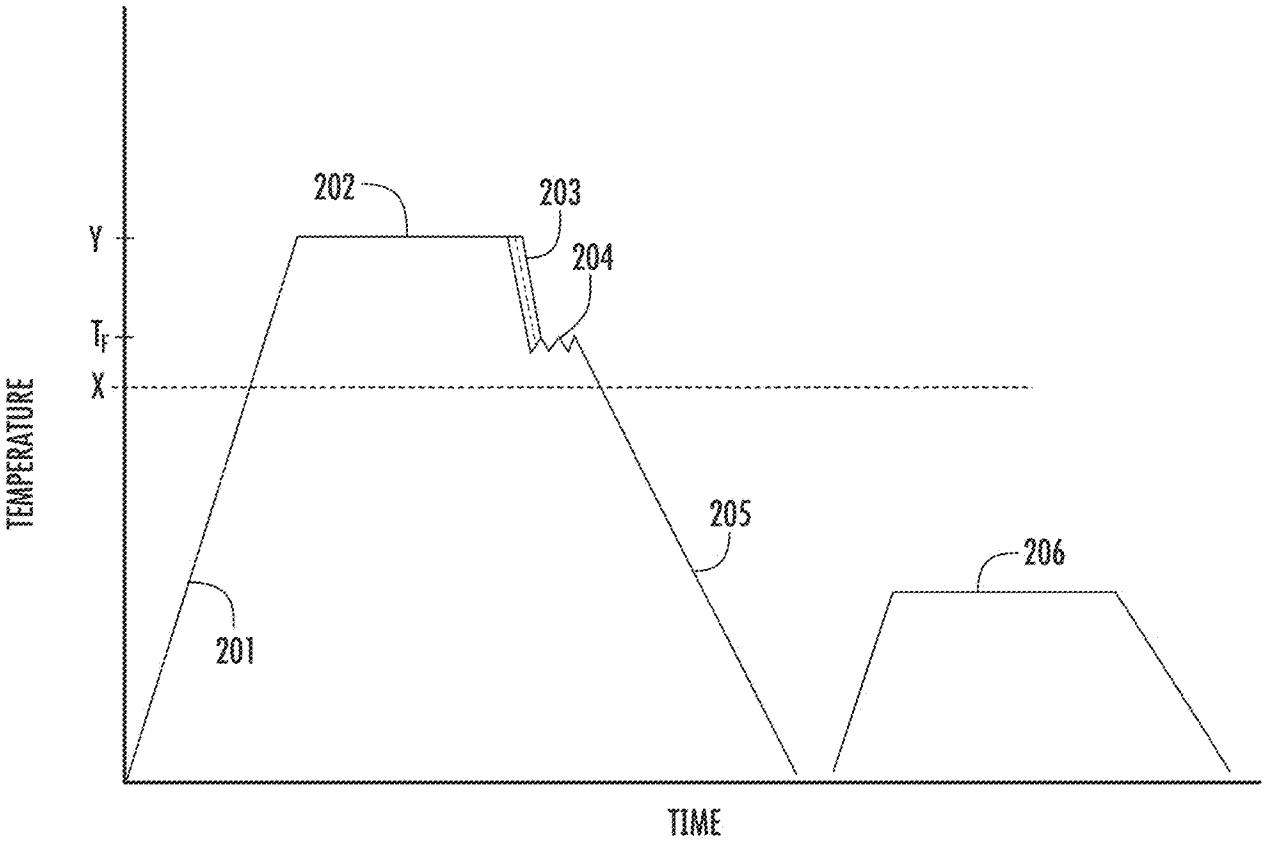
FIG. 2 is a temperature plot of the method of FIG. 1.

FIGS. 1-9B illustrate examples of hot working aluminum alloy components. As shown in FIGS. 1 and 2, a method of hot forming an aluminum alloy component (e.g., component 50) may include removing the component 50 from a supply of alloy blanks 104, heating the component 50 in a heating furnace 103 to a solutionizing temperature Y, cooling the component 50 to a desired forming temperature $T_F$, deforming the component 50 into a desired shape in a forming device 102 while the component 50 is at the desired forming temperature $T_F$, quenching the component 50 to a low temperature below a solvus temperature X, and artificially aging the component 50.

Figure 4:
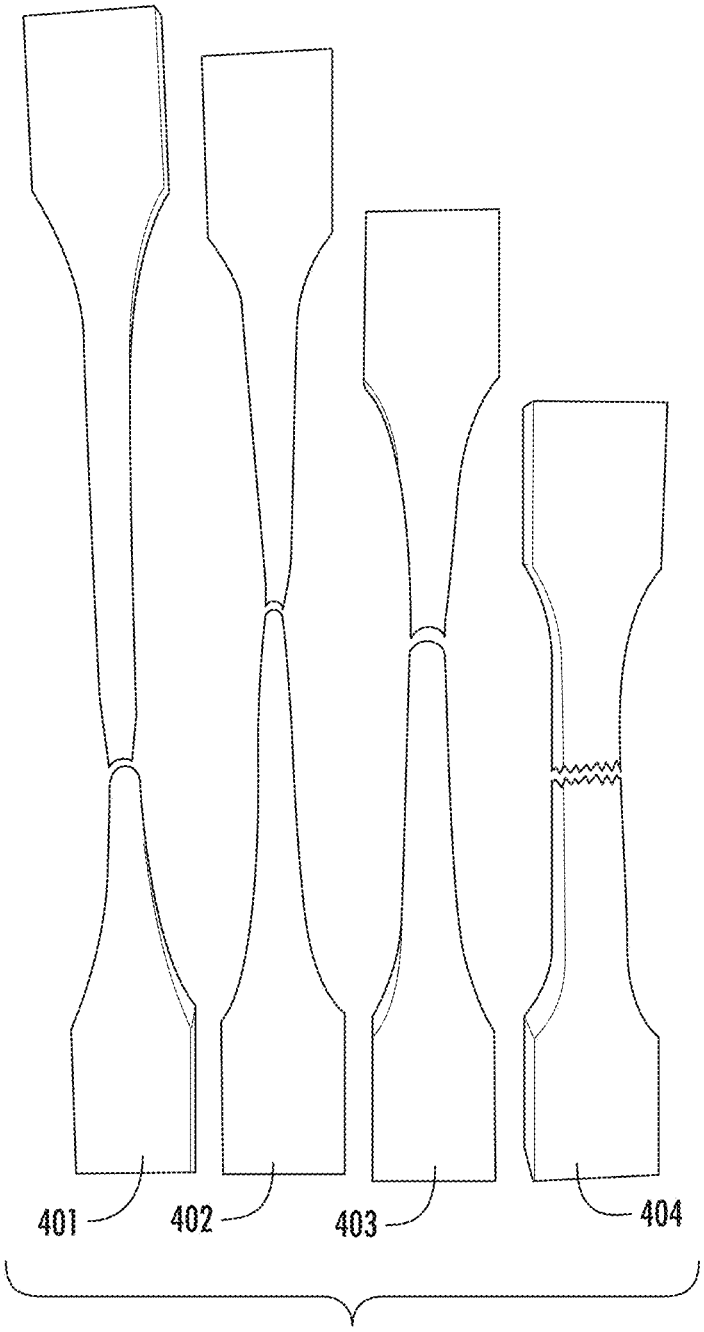
FIG. 4 shows aluminum alloy tensile test samples for various temperatures.

To effectively hot form a 7xxx aluminum alloy component, the component must be heated to increase ductility (i.e., a measure of the degree to which a material may be deformed without breaking) and to eliminate strain hardening. In general, the ductility of aluminum increases with increasing temperature. However, experiments have been conducted for both tensile and compressive tests for 7xxx alloys, which contradict this characteristic. For example, FIG. 4 shows four "dog bone" tensile test specimens for 7075 alloy. The first specimen 401 is from a tensile test completed at 425° C. The three remaining test specimens are from higher temperature tests (25° C. increments) where 402 is from a 450° C. tensile test, 403 is from a 475° C. tensile test, and 404 is from a 500° C. tensile test. As shown in FIG. 4, the samples from the experiments conducted at 475° C. and 500° C., 403 and 404, respectively, exhibit significantly less ductility compared to the 425° C. sample 401. In other words, the 500° C. specimen 404 deformed significantly less (i.e., plastically deformed by stretching in the longitudinal direction) than the 425° C. sample 401. The 425° C. sample 401 and the 450° C. sample 402 show significantly more necking before failure. The results of these tensile tests support a conclusion that 7xxx aluminum (particularly, 7075 aluminum) does not show continuously increasing ductility with increasing temperature. In particular, as shown in FIG. 4, 7075 aluminum exhibits a decrease in ductility with increasing temperature after exceeding a threshold temperature. The threshold temperature appears to be between 400° C. and 450° C. Furthermore, the decrease in ductility at these elevated temperatures has been verified in laboratory trials of hot rolling 7075 ingots that exhibit edge cracking.

Detailed examination of the fracture surfaces (of samples such as those shown in FIG. 4) revealed distinct cup-and-cone dimple fractures consistent with ductile fracture for the 425° C. sample 401 while the surfaces of the 475° C. sample 403 revealed intergranular fractures consistent with brittle fractures. In some examples, detailed examination occurred by viewing magnified images of the samples, such as via SEM micrograph.

Figure 3:
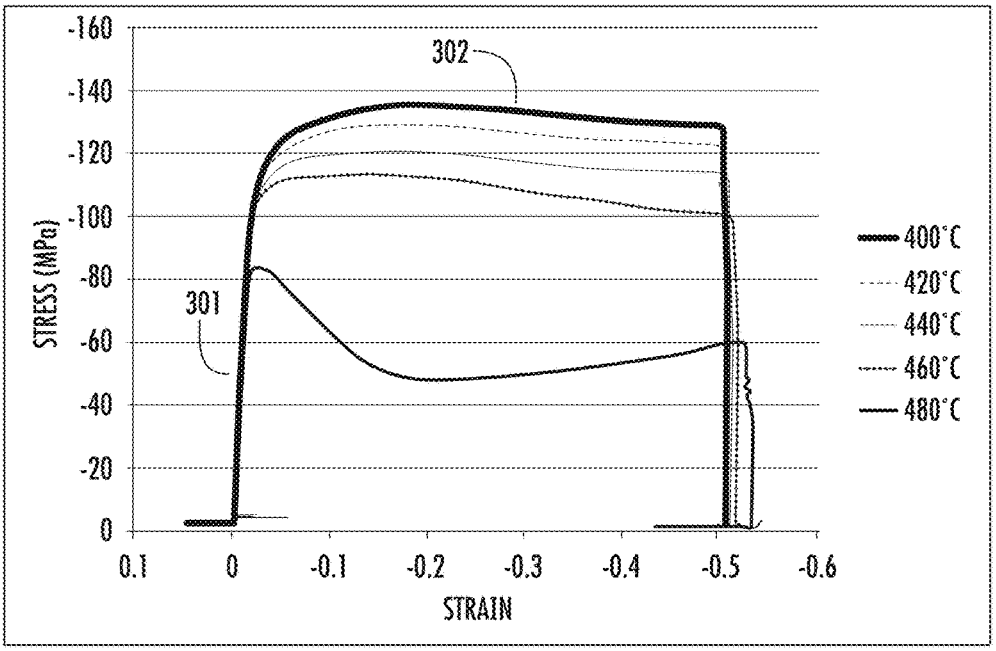
FIG. 3 is a stress-strain plot for aluminum alloy components tested in compression for various temperatures.

Compression tests were conducted using a Gleeble 3800 thermomechanical simulator (manufactured by Dynamic Systems Inc. in Poestenkill, N.Y.) for various temperatures with 7xxx samples. The compression tests were conducted for 7075 samples at a constant strain rate of 10 $s^{-1}$ up to a strain of 0.5. FIG. 3 illustrates stress-strain curves for compression testing at temperatures from 400° C. to 480° C. in 20° C. increments. The curves in FIG. 3 show an initial (approximately linear) elastic deformation region 301 and a plastic deformation region 302. The 460° C. and 480° C. samples each failed under compression loading and exhibited cracks. The 480° C. sample completely failed (cracked) during the test. As shown in FIG. 3, the flow stress (i.e., the instantaneous value of stress required to continue plastically deforming the material) decreases with increasing temperature.

Figure 5:
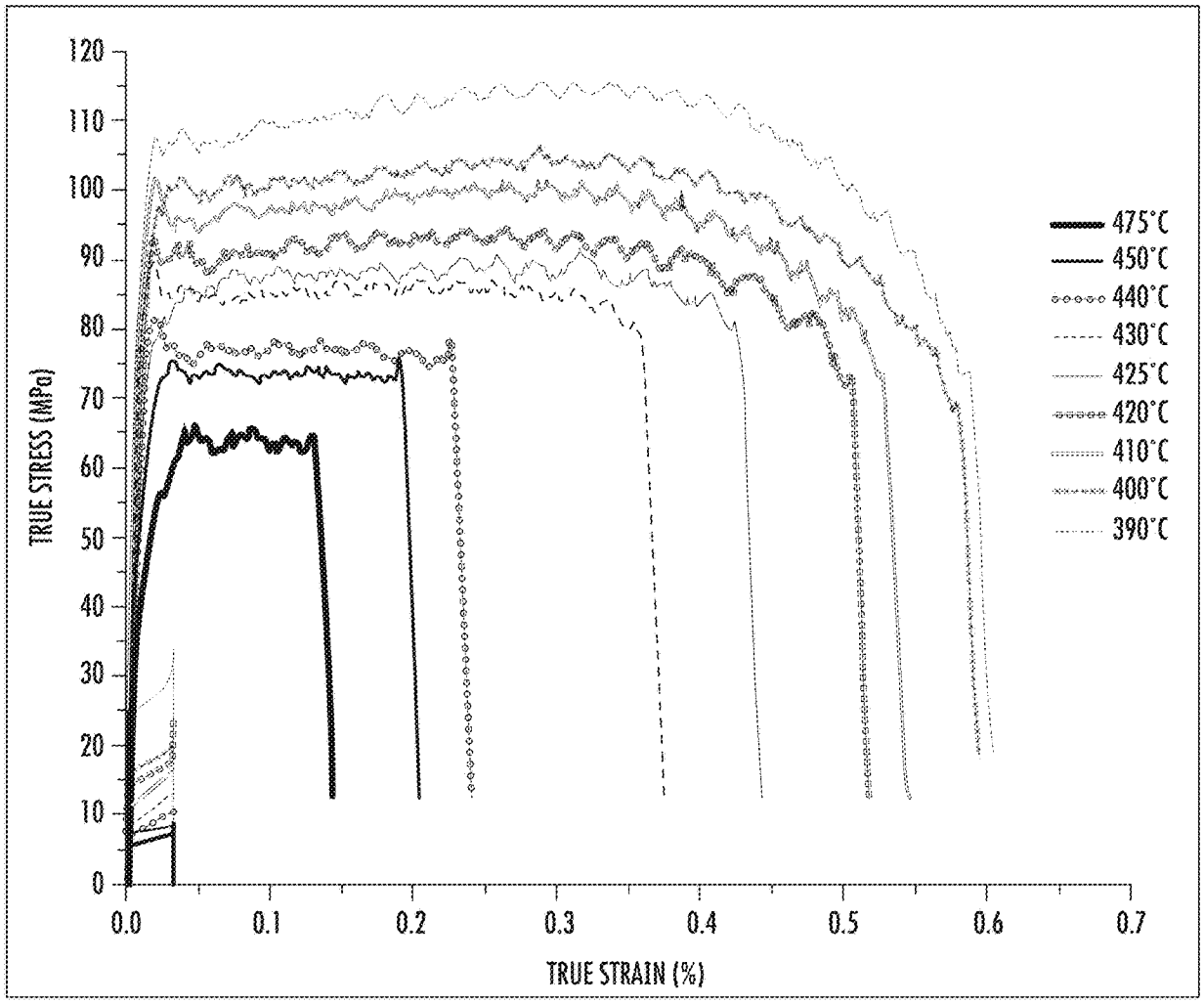
FIG. 5 is a stress-strain plot for aluminum alloy components tested in tension for various temperatures.

In addition to the compression tests, results of tensile tests are shown in FIG. 5. FIG. 5 shows stress-strain curves for tensile testing at temperatures of 390° C., 400° C., 410° C., 420° C., 425° C., 430° C., 440° C., 450° C., and 475° C. The results show a drop in flow stress when the temperature is increased (similar to the compression results in FIG. 3). The results further show a decrease in the true strain before failure with increasing forming temperature. Samples formed at temperatures less than or approximately 425° C. (e.g., approximately 390° C., approximately 400° C., approximately 410° C., approximately 420° C., and approximately 425° C.) show true strain percentage greater than approximately 0.44% before failure. Samples formed at temperatures greater than approximately 425° C. (e.g., approximately 430° C., approximately 440° C., approximately 450° C., and approximately 475° C.) show significantly reduced true strain before failure. As shown in FIG. 5, the alloy strength is decreased with increasing forming temperature.

Based on the aforementioned experiments and subsequent conclusions, a new method for hot working 7xxx aluminum alloy components is described herein.

As shown in FIG. 1, the component 50 is removed from the supply of alloy blanks 104 and inserted into the heating furnace 103. FIG. 2 illustrates the changes in temperature of the component 50. After entering the heating furnace 103, the temperature increases (see 201 in FIG. 2) above the solvus temperature X (i.e., the limit of solid solubility). Once the component 50 reaches the target solutionizing temperature Y, the component 50 is maintained at the solutionizing temperature Y for a predetermined time 202. The solutionizing temperature Y is between approximately 400° C. and approximately 600° C. In some cases, the solutionizing temperature is in a range of approximately 420° C. to approximately 590° C. or in a range of approximately 460° C. to approximately 520° C. In some examples, the solutionizing temperature Y has a minimum value of 480° C. and in some cases is equal to approximately 480° C. The predetermined time for maintaining the component 50 at the solutionizing temperature Y depends on the particular component 50 for solution heating and may be up to 30 minutes.

After the solution heating is complete, the component 50 is intentionally cooled (see 203 in FIG. 2) to a desired forming temperature $T_F$ (see 204 in FIG. 2). This cooling step 203 before forming contradicts the '416 Publication, which explicitly discloses immediate forming and requires minimal heat loss before forming in an attempt to form at temperatures close to if not equal to the heat treatment temperature.

In some examples, the cooling step 203 occurs during the transfer from the heating furnace 103 to the forming device 102. As shown in FIG. 1, the component 50 may be transferred via an insulated enclosure 101. The transfer between the heating furnace 103 and the forming device 102 occurs in a predetermined time. This predetermined time may be several minutes, such as, for example, 1, 2, or 3 minutes. In some non-limiting examples, this predetermined time may be less than 60 seconds and, in particular, may be approximately 20 seconds.

Once the component 50 reaches the desired forming temperature $T_F$, the forming process 204 (FIG. 2) occurs in the forming device 102 (FIG. 1). As shown in FIG. 2, the temperature of the component 50 may be held approximately constant at the desired forming temperature $T_F$ during the forming process. The forming temperature $T_F$ may be any temperature in the range of approximately 380° C. to approximately 470° C., for example in the range of approximately 390° C. to approximately 460° C. or in the range of approximately 400° C. to approximately 440° C. The temperature of the component 50, for example, may be held constant at the desired forming temperature $T_F$±10° C., may be held constant at the desired forming temperature $T_F$±5° C., or may be held constant at the desired forming temperature $T_F$±1° C. In some examples, heat may be applied to the component 50 during the forming process in the forming device 102 to ensure the component 50 is maintained at the desired forming temperature $T_F$.

Figure 8A:
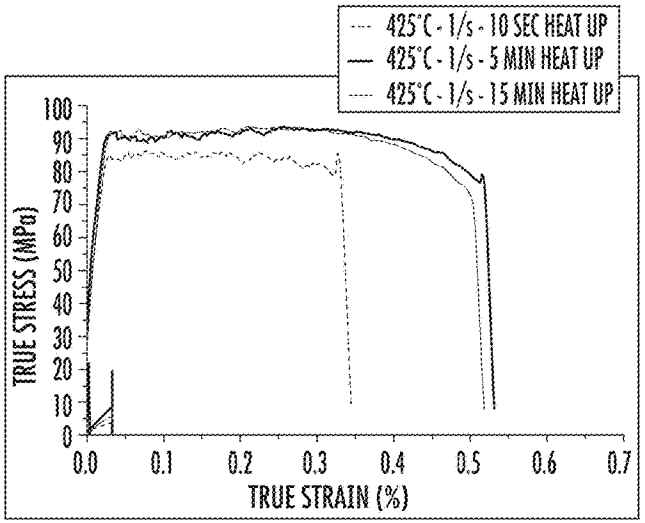
FIG. 8A is a stress-strain plot for aluminum alloy components tested in tension after being heated at various rates.
Figure 8B:
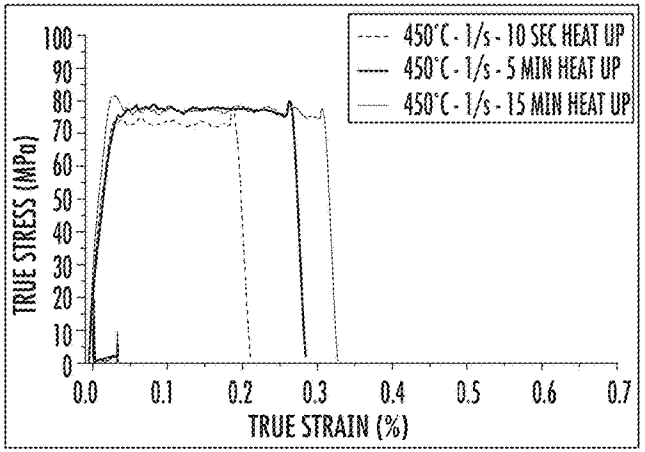
FIG. 8B is a stress-strain plot for aluminum alloy components tested in tension after being heated at various rates.

The effect of heating rate to the solutionizing temperature Y for the component 50 was also evaluated, and both ductility and microstructure were characterized. Component 50 samples were heated to the solutionizing temperature Y (approximately 480° C.) over the following approximate time periods: 10 seconds, 5 minutes and 15 minutes. FIG. 8A shows the tensile characteristics of the component 50 when cooled to and maintained at 425° C. after solutionizing heat treatment. When heated quickly (approximately 10 seconds), the component 50 exhibited significantly reduced ductility, as well as smaller grain size (see FIG. 9A). In particular, as shown in FIG. 8A, failure for the 10 second heated sample occurred at less than 0.35% strain, compared to failure at greater than 0.5% for other illustrated rates. Heating the component 50 to the solutionizing temperature Y at lower rates (i.e., longer times) allowed higher ductility and a corresponding larger grain size (see FIG. 9B, which shows a magnified view of the 5 minute heated sample having larger grain sizes than the 10 second heated sample shown in FIG. 9A). FIG. 8B shows the high temperature tensile characteristics of the component 50 when cooled to and maintained at 450° C. after solutionizing heat treatment. The ductility of the component 50 is reduced significantly from the samples tested at 425° C. Furthermore, as shown in FIG. 8B, failure for the 10 second heated sample occurred at approximately 0.2% strain, compared to failure at approximately 0.3% for other illustrated rates.

Figure 6A:
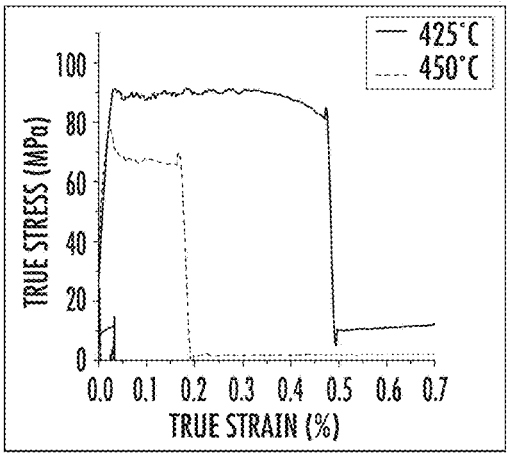
FIG. 6A is a stress-strain plot for aluminum alloy components tested in tension for various temperatures.
Figure 7A:
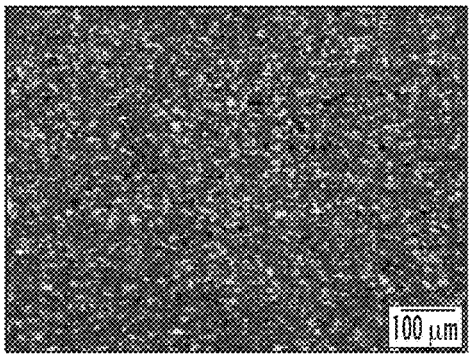
FIG. 7A is a magnified view showing grain structures of an aluminum alloy component.
Figure 6B:
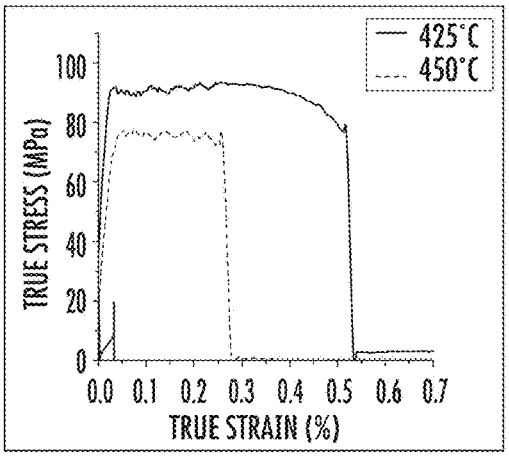
FIG. 6B is a stress-strain plot for aluminum alloy components tested in tension for various temperatures.
Figure 7B:
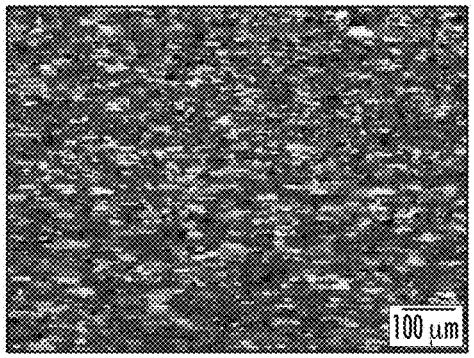
FIG. 7B is a magnified view showing grain structures of an aluminum alloy component.
Figure 6C:
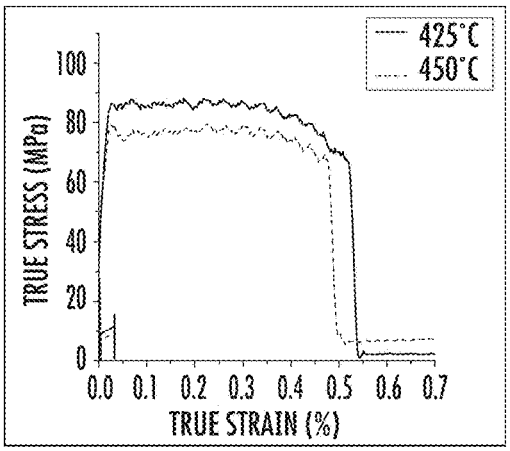
FIG. 6C is a stress-strain plot for aluminum alloy components tested in tension for various temperatures.
Figure 7C:
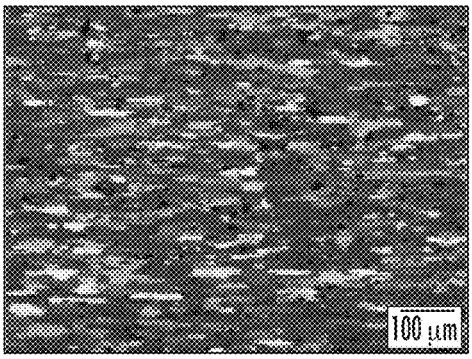
FIG. 7C is a magnified view showing grain structures of an aluminum alloy component.
Figure 9A:
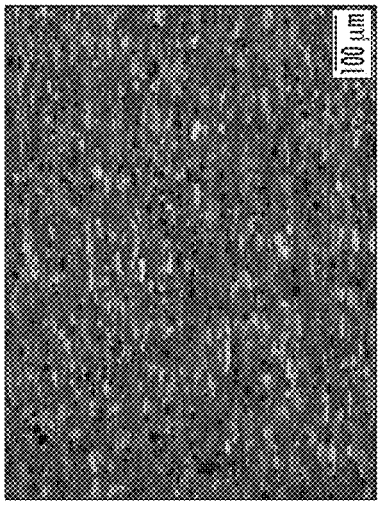
FIG. 9A is a magnified view showing grain structures of an aluminum alloy component that was heated to solutionizing temperature in approximately 10 seconds.
Figure 9B:
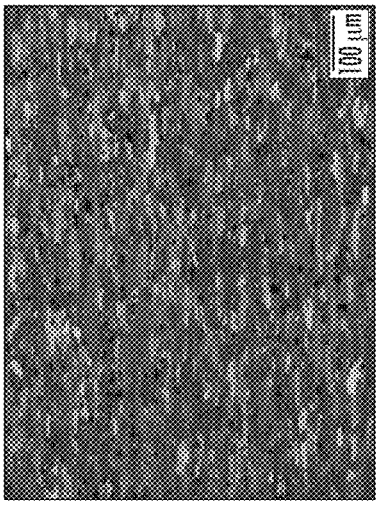
FIG. 9B is a magnified view showing grain structures of an aluminum alloy component that was heated to solutionizing temperature in approximately 5 minutes.

The reduction in ductility at temperatures above about 420° C. was evaluated according to the microstructure of the component 50. FIG. 6A demonstrates an approximate 60% decrease in ductility for a sample tested at approximately 450° C. (tensile conditions) compared to a sample at approximately 425° C. The microstructure for this alloy is shown in FIG. 7A, where the approximate grain size (or approximate diameter) is about 10 microns. FIG. 6B demonstrates an approximate 50% decrease in ductility for a sample tested at approximately 450° C. (tensile conditions) compared to a sample at approximately 425° C. The microstructure for this alloy is shown in FIG. 7B, where the approximate grain size (or approximate diameter) is about 25 microns. In some embodiments, the grain size is approximately 15-35 microns. FIG. 6C demonstrates an approximate 7% decrease in ductility for a sample tested at approximately 450° C. (tensile conditions) compared to a sample at approximately 425° C. The microstructure for this alloy is shown in FIG. 7C, where the approximate grain size (or approximate diameter) is about 75 microns. In some embodiments, the grain size is approximately 65-85 microns. High temperature formability of 7xxx aluminum alloys appears to be dependent on grain size based on these experiments. For example, as shown in FIGS. 6A and 6C, when comparing an approximate grain size of 75 microns and 10 microns, the larger grain size produces greater ductility at 425° C. (failure at approximately 0.55% strain compared to approximately 0.5% strain). In addition, as shown in FIGS. 6A and 6C, when comparing an approximate grain size of 75 microns and 10 microns, the larger grain size produces significantly greater ductility at 450° C. (failure at approximately 0.5% strain compared to approximately 0.2% strain).

Based on the experiments described above, it has been determined that the desired forming temperature $T_F$ is in a range of approximately 380° C. to approximately 470° C., for example in the range of approximately 390° C. to approximately 460° C. or in the range of approximately 400° C. to approximately 440° C. In some cases, the desired forming temperature $T_F$ is approximately 425° C. The component 50 must be hot enough to ensure sufficient formability; however, as shown in FIG. 4, at elevated temperatures, the 7075 aluminum alloy components become less ductile and increasingly brittle with increasing temperature (particularly at temperatures of 450° C.-475° C. and higher).

The forming process 204 occurs in the forming device 102, which may be a forming press (i.e., including a die), a rolling mill, or any other suitable forming device. In some examples, the forming process 204 lasts a few seconds (e.g., less than 10 seconds).

After the forming process is complete, the component 50 is quenched to a low temperature at 205 in FIG. 2. The low temperature may be approximately 0° C. to approximately 280° C., or may be approximately 5° C. to approximately 40° C., or may be approximately 23° C. in certain embodiments. In some cases, the quenching occurs in a closed die with internal water cooling such that cooling water flows through internal passages in the die. The component 50 may be cooled at a minimum rate of approximately 50° C./second. The cooling or quench rate may be between approximately 50° C./second and approximately 500° C./second or may be between 300° C./second and approximately 350° C./second. In some instances, more advantageous material properties are observed for higher quench rates such as more than 300° C./second.

As shown in FIG. 2, after the quenching process 205 is complete, the component 50 may undergo an artificial aging treatment 206. In particular, the artificial aging treatment 206 may include heat treatment at a temperature of approximately 100° C. to 150° C. (in some cases, approximately 125° C.) for approximately 24 hours. In some cases, the component 50 may undergo a double aging treatment that includes heat treatment at a temperature of approximately 100° C. to 150° C. (in some cases, approximately 125° C.) for 1-24 hours followed by heat treatment at approximately 180° C. for approximately 20-30 minutes.

Different arrangements of the objects depicted in the drawings or described above, as well as features and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A method of hot forming an aluminum alloy component, the method comprising:

heating the aluminum alloy component in a heating furnace to a solutionizing temperature;

cooling the aluminum alloy component to a desired forming temperature in a range of approximately 380° C. to approximately 470° C.;

deforming the aluminum alloy component into a desired shape in a forming device while the aluminum alloy component is at the desired forming temperature, wherein the aluminum alloy component is transferred from the heating furnace to the forming device through an insulated enclosure; and quenching the aluminum alloy component to a low temperature below a solvus temperature, wherein the low temperature is in a range of approximately 0° C. to approximately 280° C.

2. The method of claim 1, wherein the aluminum alloy component comprises a 7xxx alloy.

3. The method of claim 1, wherein the aluminum alloy component comprises a 7075 alloy.

4. The method of claim 1, wherein the desired forming temperature is in a range of approximately 400° C. to approximately 440° C.

5. The method of claim 1, wherein the solutionizing temperature is in a range of approximately 400° C. to approximately 600° C.

6. The method of claim 1, wherein the solutionizing temperature is approximately 480° C.

7. The method of claim 1, wherein the heating of the aluminum alloy component to the solutionizing temperature occurs in a range of approximately 10 seconds to 15 minutes.

8. The method of claim 1, wherein the heating of the aluminum alloy component to the solutionizing temperature occurs in approximately 5 minutes.

9. The method of claim 1, wherein the aluminum alloy component comprises an approximate grain size of 65-85 microns, wherein the approximate grain size is measured after the aluminum alloy component is heated to the solutionizing temperature.

10. The method of claim 1, further comprising artificially aging the aluminum alloy component.

11. The method of claim 1, further comprising maintaining a constant temperature during the deformation of the aluminum alloy component, wherein the constant temperature is held to within ±10° C.

12. The method of claim 1, wherein:

the aluminum alloy component is an ingot;

the forming device is a rolling mill; and the desired shape is a plate or a sheet.

13. The method of claim 1, wherein the forming device is a forming press.

14. The method of claim 1, further comprising maintaining the aluminum alloy component at the solutionizing temperature for a predetermined time, wherein the predetermined time is up to approximately 30 minutes.

15. The method of claim 1, wherein the quenching comprises die quenching with water flowing internally through a die such that the aluminum alloy component is cooled at a rate between approximately 50° C./second and approximately 500° C./second.

16. A method of hot forming an aluminum alloy component, the method comprising:

heating the aluminum alloy component in a heating furnace to a solutionizing temperature of approximately 480° C.;

cooling the aluminum alloy component to a desired forming temperature in a range of approximately 400° C. to approximately 440° C.;

deforming the aluminum alloy component into a desired shape in a forming device while the aluminum alloy component is at the desired forming temperature, wherein the aluminum alloy component is transferred from the heating furnace to the forming device through an insulated enclosure;

maintaining a constant temperature during the deformation of the aluminum alloy component, wherein the constant temperature is held within ±10° C.; and quenching the aluminum alloy component to a low temperature below a solvus temperature, wherein the low temperature is approximately 23° C.

17. The method of claim 16, wherein the aluminum alloy component comprises a 7075 alloy.

18. The method of claim 16, further comprising artificially aging the aluminum alloy component.

19. The method of claim 16, wherein:

the aluminum alloy component is an ingot;

the forming device is a rolling mill; and the desired shape is a plate or a sheet.

20. The method of claim 16, wherein the forming device is a forming press.

21. The method of claim 16, further comprising maintaining the aluminum alloy component at the solutionizing temperature for a predetermined time, wherein the predetermined time is up to approximately 30 minutes.

22. The method of claim 16, wherein the quenching comprises die quenching with water flowing internally through a die such that the aluminum alloy component is cooled at a rate between approximately 50° C./second and approximately 500° C./second.

* * * * *